US007670135B1

(12) United States Patent
Zink et al.

(10) Patent No.: US 7,670,135 B1
(45) Date of Patent: Mar. 2, 2010

(54) BURNER AND METHOD FOR INDUCTION OF FLUE GAS

(75) Inventors: Darton J. Zink, Tulsa, OK (US); Rex K. Isaacs, Tulsa, OK (US); John McDonald, Broken Arrow, OK (US); Tim Kirk, Morris, OK (US); Cody L. Little, Coweta, OK (US)

(73) Assignee: Zeeco, Inc., Tulsa, OK (US)

( * ) Notice: Subject to any disclaimer, the term of this patent is extended or adjusted under 35 U.S.C. 154(b) by 1266 days.

(21) Appl. No.: 11/180,387

(22) Filed: Jul. 13, 2005

(51) Int. Cl.
*F23M 3/00* (2006.01)
*F23M 3/12* (2006.01)

(52) U.S. Cl. ..... 431/9; 431/116; 431/202

(58) Field of Classification Search ..... 431/9, 431/116, 202
See application file for complete search history.

(56) References Cited

U.S. PATENT DOCUMENTS 2,918,117 A * 12/1959 Griffin ..... 431/116
4,277,942 A * 7/1981 Egnell et al. ..... 60/517
5,073,105 A * 12/1991 Martin et al. ..... 431/116
5,098,282 A * 3/1992 Schwartz et al. ..... 431/9
5,284,438 A * 2/1994 McGill et al. ..... 431/9
5,344,307 A 9/1994 Schwartz et al.
5,458,481 A 10/1995 Surbey et al.
5,542,840 A * 8/1996 Surbey et al. ..... 431/116
6,499,990 B1 12/2002 Zink et al.
6,672,858 B1 1/2004 Benson et al.
6,695,609 B1 2/2004 Chung et al.
6,875,008 B1 * 4/2005 Martin et al. ..... 431/9
2001/0034001 A1 * 10/2001 Poe et al. ..... 431/116
2005/0239005 A1 * 10/2005 Lugnet et al. ..... 431/8

* cited by examiner

*Primary Examiner*—Carl D Price
(74) *Attorney, Agent, or Firm*—Fellers, Snider, Blankenship, Bailey & Tippens, P.C.; Dennis D. Brown

(57) ABSTRACT

A low $NO_x$ burner and method wherein (a) combustion air flows through the interior of the burner in a manner effective for drawing an amount of inert flue gas diluent from the fired heating system into the combustion air stream, preferably via one or more induction channels provided through the burner wall, and/or (b) air or an inert gas is discharged into the induction channel(s) in a manner effective for delivering flue gas into the combustion air stream.

43 Claims, 5 Drawing Sheets

BURNER AND METHOD FOR INDUCTION OF FLUE GAS

FIELD OF THE INVENTION

The present invention relates to burners and methods which utilize flue gas recirculation for reducing $NO_x$ emissions from process heaters, boilers, and other fired heating systems.

BACKGROUND OF THE INVENTION

Many industrial applications require large scale generation of heat from burners for process heaters, boilers, or other fired heating systems. If the burner fuel is thoroughly mixed with air and combustion occurs under ideal conditions, the resulting combustion products are primarily carbon dioxide and water vapor. However, when the fuel is burned under less than ideal conditions, such as in a high temperature environment, nitrogen present in the combustion air reacts with oxygen to produce nitrogen oxides ($NO_x$). It is well known that, other conditions being equal, $NO_x$ production increases as the temperature of the combustion process increases. $NO_x$ emissions are generally considered to contribute to ozone depletion and other environmental concerns.

Burners designed for combusting fuel with air in a manner resulting in reduced $NO_x$ emissions are commonly referred to as "low $NO_x$" burners. In some low $NO_x$ burners now used in the art, flue gases produced in the combustion process are recirculated through the burner apparatus to dilute the fuel/air mixture in the combustion zone and thereby lower the burner flame temperature. However, when the flue gas is recirculated from the interior of the fired heater without significant cooling, the temperature of the recirculated flue gas is still extremely high when it enters the combustion zone. The high temperature of the recirculated flue gas itself thus counteracts some of the beneficial dilution effect of the recirculated flue gas and limits the amount of $NO_x$ reduction achieved.

A need presently exists for an efficient, improved low $NO_x$ burner apparatus and method utilizing recirculated flue gas wherein the temperature of the flue gas is significantly reduced prior to being delivered into the burner flame, but without losing any heat energy from the combustion system. A need particularly exists for an improved low $NO_x$ burner apparatus and method of this type which is not complex in design and which provides stable performance over a broad range of operating conditions. In addition, a need exists for a burner apparatus and method of this type which can be operated in a manner effective for significantly increasing the amount of recirculated flue gas used in the burner.

U.S. Pat. No. 5,458,481 discloses a staged fuel burner having a primary combustion zone within the central passageway of the burner block (i.e., the burner wall) and a secondary fuel combustion stage provided at the outer end of the block. The burner block includes a plurality of vertical flue gas recirculation passageways around the central passageway. Each of the vertical recirculation passageways has a lateral injection passageway at the bottom thereof which extends into the central passageway. Fuel jets are positioned in the lower ends of the vertical recirculation passageways for injecting primary fuel gas into the lateral injection passageways. The injection of the primary fuel gas draws flue gas through the vertical recirculation passageways and then carries the flue gas through the lateral injection passageways.

In the burner of U.S. Pat. No. 5,458,481, the injected primary fuel gas undergoes localized combustion in the presence of the inert recirculated flue gas in a primary combustion region within the central passageway of the burner wall at the discharge outlets of the lateral injection passageways. Directing structures are positioned within the burner adjacent to the discharge openings of the lateral injection passageways for separating the local combustion of the primary fuel gas from the main body of air flowing through the central passageway. Each of the directing structures has a perforated bottom plate which allows a sufficient amount of air to pass therethrough for supporting the localized combustion of the primary fuel gas. A plurality of secondary fuel jets are provided at the forward end of the burner block for ejecting secondary fuel gas laterally into the secondary combustion zone at the end of the burner block.

U.S. Pat. No. 6,499,990 discloses a particularly effective low $NO_x$ burner apparatus and method wherein the burner preferably has only a single combustion zone. The combustion zone is located at the forward end of the burner wall and receives combustion air via an interior passageway having an outlet at the forward end. Fuel gas is delivered to the combustion zone by a plurality of ejectors which are positioned outside and rearwardly of the forward end of the burner wall. The fuel gas is ejected outside of the burner wall in a plurality of free jet flow paths such that flue gas is entrained in the fuel gas as it travels toward the combustion zone. The burner can also comprise one or more exterior impact structures positioned to assist in further mixing the flue gas with the fuel. The impact structure(s) can comprise(s) one or more ledges formed on the exterior of the burner wall. Alternatively, the exterior of the burner can be sloped (e.g., frustoconical) or straight (e.g., cylindrical). The entire disclosure of U.S. Pat. No. 6,499,990 is incorporated herein by reference.

The manner of ejection and delivery of fuel gas outside of the burner wall as employed in U.S. Pat. No. 6,499,990 is effective for entraining a sufficient amount of inert flue gas in the fuel gas stream to significantly reduce $NO_x$ emissions. Moreover, because of its single-stage design and operation, the burner of U.S. Pat. No. 6,499,990 is less complex than other low $NO_x$ burners previously known in the art and is also safer, more stable, and simpler to operate, control, and maintain. In addition, the burner of U.S. Pat. No. 6,499,990 provides a much broader stable operating range (turn down ratio) than is available with staged fuel or staged air burners and can be more readily and conveniently sized and adapted for use in different fired heating systems.

U.S. Pat. No. 6,695,609 discloses a low $NO_x$, staged fuel burner wherein the exterior of the burner wall is divided by radial baffles into a series of alternating sections which have different heights and which slant inwardly toward the outer end of the burner wall at different angles. Some of the wall sections have a lateral opening formed through the base thereof through which primary fuel gas is injected. The primary fuel gas entrains an amount of flue gas from the heating system and carries the flue gas into the burner. The primary fuel gas/flue gas mixture is combusted within the burner wall beginning in the vicinity of the lateral openings. A radial ledge positioned within the burner just below the lateral openings functions as a flame stabilizing surface for the primary combustion zone. Secondary fuel gas is discharged outside of the burner wall such that the secondary fuel gas entrains additional flue gas as it travels toward a secondary combustion zone located at the forward end of the burner.

SUMMARY OF THE INVENTION

The present invention provides a low $NO_x$ burner apparatus and method which satisfy the needs and alleviate the problems discussed above. The inventive low $NO_x$ burner and method allow single stage burner operation and also provide all of the other benefits and advantages of the prior art burner and method described in U.S. Pat. No. 6,499,990. In addition, however, the inventive burner and method allow the use of significantly more flue gas diluent in the combustion zone and/or also operate to greatly reduce the temperature of the flue gas diluent by mixing at least a significant portion of the diluent with the burner combustion air stream well prior to reaching the combustion zone. The mixing and cooling of the flue gas with the air stream is also preferably accomplished prior to adding any fuel to the combustion air. Thus, the inventive burner and method provide even greater reductions in $NO_x$ emissions.

In one aspect, there is provided an improved burner for combusting a combustion fuel in a heating system, the heating system having a flue gas therein and the burner including a burner wall having an air passageway therein for delivering a flow of air for combustion. The improvement comprises at least one flue gas induction channel extending through the burner wall to the air passageway such that the flow of air through the air passageway will draw an amount of the flue gas through the flue gas induction channel and into the air passageway. This is accomplished without any of the combustion fuel being delivered fuel through the flue gas induction channel.

In another aspect, there is provided a burner for reduced $NO_x$ emissions in a heating system having a flue gas therein, the burner comprising: a burner wall having an air passageway therein for delivering a flow of air for combustion; a plurality of flue gas induction channels extending through the burner wall and having outlet openings in the air passageway; and a barrier positioned in the air passageway such that the flow of air will create a reduced pressure region within the barrier adjacent to the outlet openings effective for drawing an amount of the flue gas into the air passageway through the flue gas induction channels.

In another aspect, there is provided a method for reducing $NO_x$ emissions from a burner in a heating system having a flue gas therein wherein the burner includes a burner wall having an interior passageway with an outlet at the forward end of the burner wall and the burner also includes a combustion zone, beginning substantially at the forward end, wherein a combustion fuel is burned. The method comprises the step of delivering a flow of air for combustion through the interior passageway toward the combustion zone in a manner such that the flow of air creates a reduced pressure region in the interior passageway which draws an amount of the flue gas into the flow of air in the interior passageway prior to the flow of air reaching the combustion zone. The burner is operated such that there is no additional combustion stage located within said burner wall prior to the combustion zone.

In another aspect, there is provided a burner for combusting a combustion fuel in a heating system, the heating system having a flue gas therein and the burner including a burner wall having an air passageway therein for delivering a flow of air for combustion. The improvement comprises at least one flue gas induction channel extending through the burner wall to the air passageway and a jet positioned in the flue gas induction channel which will discharge air or an inert gas in a manner effective for drawing an amount of the flue gas into the flue gas induction channel and delivering the amount of the flue gas to the air passageway.

In another aspect, there is provided a method of reducing $NO_x$ emissions from a burner in a heating system having a flue gas therein, the burner including a burner wall having a forward end and an interior passageway having an outlet at the forward end, and the burner including a combustion zone wherein a combustion fuel is burned, the combustion zone beginning substantially at the forward end. The method comprises the step of discharging air or an inert gas into at least one induction channel, the induction channel extending through the burner wall to the interior passageway, in a manner effective for drawing an amount of the flue gas into the induction channel and delivering the amount of the flue gas to the interior passageway. The burner is operated such that there is not additional combustion stage located within the burner wall prior to the combustion zone.

Further aspects, features, and advantages of the present invention will be apparent to those in the art upon examining the accompanying drawings and upon reading the following Detailed Description of the Preferred Embodiments.

DETAILED DESCRIPTION OF THE PREFERRED EMBODIMENTS

Figure 1:
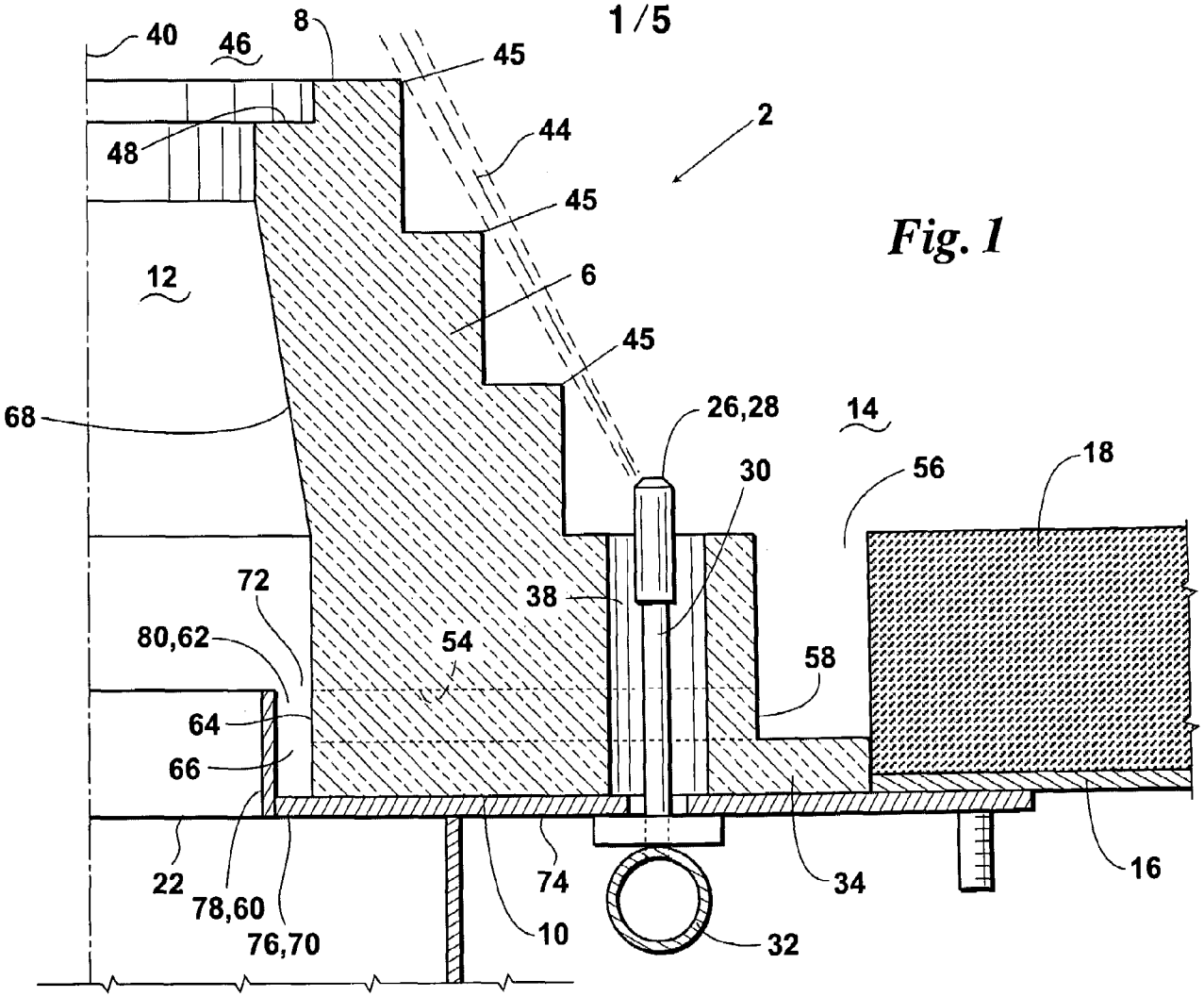
FIG. 1 is an elevational cutaway sectional view of an embodiment 2 of the inventive low $NO_x$ burner.
Figure 3:
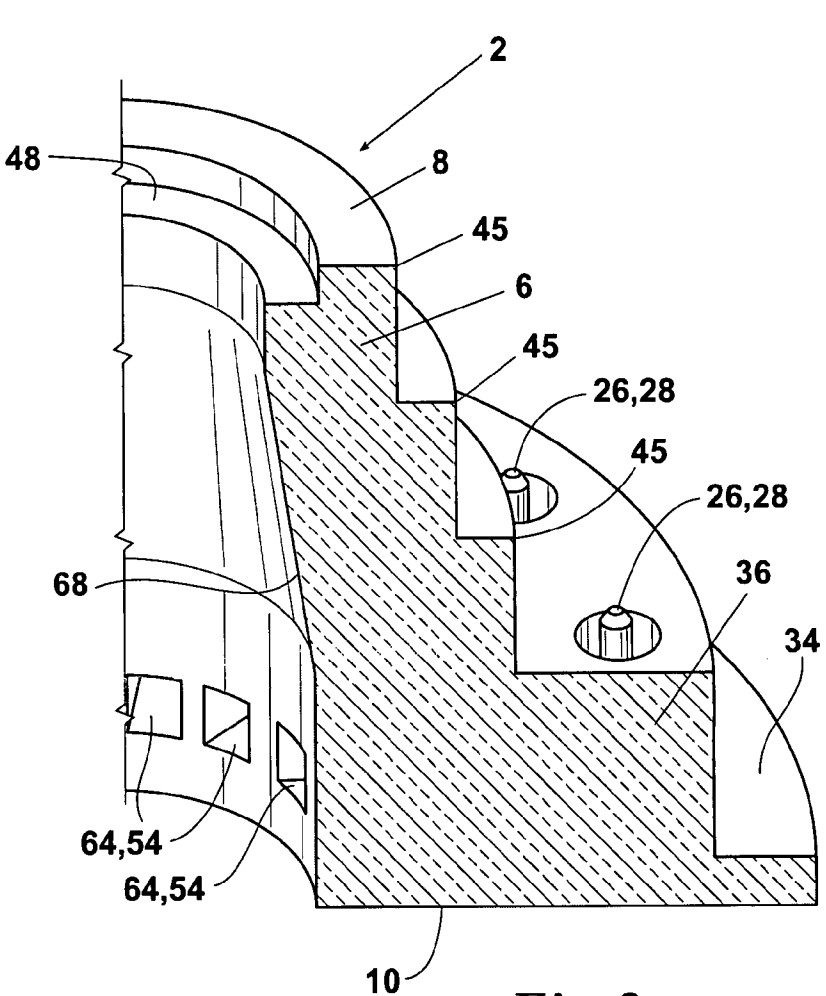
FIG. 3 is a perspective interior section view of the inventive low $NO_x$ burner 2.

An embodiment 2 of the inventive low $NO_x$ burner is shown in FIGS. 1-5. Embodiment 2 of the inventive burner is a single stage burner comprising a housing 4 and a burner wall (also referred to as a burner block) 6. The burner wall 6 has an outlet or forward end 8, a base end 10, and a central air passageway or throat 12 extending therethrough and is preferably constructed of a high temperature refractory burner tile material. The forward end 8 of burner 2 is in communication with the interior 14 of a furnace or other heating system enclosure which contains combustion product gases (i.e., flue gas). Burner 2 is shown as installed through a furnace wall 16, typically formed of metal. A layer of insulating material 18 will typically be secured to the interior of the furnace wall 16. Although the inventive burner 2 is shown as being vertically mounted through the bottom wall of a fired heating system, it will be understood by those in the art that the inventive burner can alternatively be oriented downwardly, horizontally, or at generally any other desired operating angle.

A combustion air flow 20 is received in housing 4 and is directed into the inlet end 22 of the burner throat 12. The air flow 20 continues through the burner throat 12 to the outlet end 8 thereof. The quantity of combustion air entering the housing 4 can be regulated, for example, by an air damper 24. The combustion air flow 20 can be provided to housing 12 by forced circulation, natural draft, or a combination thereof, or in any other manner employed in the art.

The present invention can be used in burners designed for combusting gas fuel, liquid fuel, or a combination thereof. In embodiment 2 of the inventive burner, the burner wall 6 is preferably surrounded by a series of ejection tips, nozzles, or other fuel gas ejectors 26. Each ejector 26 is depicted as comprising a fuel ejection tip 28 secured over the distal end of a fuel pipe 30. Each fuel pipe 30 is in communication with a fuel supply manifold 32 and preferably extends through an outer portion of the base 10 of the burner wall 6. As another alternative, the fuel ejectors could be positioned completely outside of the base end 10 of burner wall 6. Each of the ejectors 26 preferably extends through a channel 38 which is formed through a lower outer ledge portion 36 of the burner wall 6 and which runs parallel to the longitudinal center line 40 of the burner wall 6.

Each of the fuel gas ejectors 26 can have any desired number of ejection ports 42 provided therein. Such ports can also be of any desired shape and can be arranged to provide generally any desired pattern or regime of fuel gas flow outside of the burner wall 6. Examples of suitable shapes and configurations include, but are note limited to, circles, ellipses, squares, rectangles, and supersonic-type ejection orifices. Additionally, the individual ejectors and/or ejection orifices 42 can be of the same configuration and type or can be of any desired combination of differing configurations. In embodiment 2 of the inventive burner, each of the ejectors 26 preferably has only a single ejection port 42 provided therein which is shaped and oriented to deliver a free jet fuel gas stream 44 toward a combustion zone 46 which preferably begins substantially at (i.e., either on or in close proximity to) the forward end 8 of burner wall 6.

As will be understood by those in the art, the term "free jet" flow refers to a jet flow issuing from an orifice, nozzle, or other ejection structure into a fluid which, compared to the jet flow, is more at rest. In embodiment 2 of the inventive burner, the fluid substantially at rest is the flue gas present in the interior 14 of the heating system. The free jet flow of fuel gas from each ejector 26 operates to entrain a portion of the flue gas and to thoroughly mix the flue gas with the fuel gas as the fuel gas streams 44 travel to the combustion zone 46 at the forward end 8 of burner wall 6. The ejection rate from each ejector 26 will preferably be in the range of from about 900 to about 1,500 feet per second and will more preferably be in the range of from about 1,100 to about 1,300 feet per second.

The ejectors 26 are preferably located in proximity to the base 10 of burner wall 6 such that they are positioned longitudinally rearward of and laterally outward from the forward end 8 of the burner wall 6. The ejectors 26 can be positioned as desired to provide any desired angular orientation of the fuel gas flow streams 44 toward the combustion zone 46. The ejectors 26 and the flow ports 42 provided therein will preferably be positioned such that each fuel gas flow stream 44 will be ejected from the flow port 42 at an angle in the range of from about 13° to about 26° with respect to the longitudinal axis 40 of the burner wall 6. Each of the flow streams 44 is most preferably oriented at an angle of about 18° from the longitudinal axis 40.

Depending primarily upon the size of the burner and the capacity requirements of the particular application in question, generally any number and spacing of the ejectors 26 can be used. The spacing between adjacent pairs of ejectors 26 will preferably be the same, but can be different. In order to provide optimum performance and fuel gas conditioning (i.e., flue gas entrainment and mixing) for most applications, the inventive burner will preferably employ a series of at least 10 ejectors positioned relatively close to each other such that the ejectors 26 provide an array of adjacent fuel gas jet flow streams 44 traveling together toward the combustion zone 46. Adjacent pairs of ejectors 26 will preferably be spaced a sufficient distance apart, however, such that neighboring ejectors 26 will not interfere with the entrainment of flue gas by the fuel gas streams 44 as they leave the ejector ports 42. Each adjacent pair of ejectors 26 will preferably be spaced from about 1 to about 4 inches apart. Each pair of adjacent ejectors 26 will more preferably be spaced from about 1 to about 3 inches apart and will most preferably be spaced about 2 inches apart.

Although the burner wall 6 of the inventive burner 2 shown in FIGS. 1-5 has a substantially circular cross section, it will be understood that each embodiment 2, 100 of the inventive burner could be circular, square, rectangular, or generally any other desired shape. In addition, the series of fuel ejectors 26 employed in the inventive burner need not entirely surround the base of the burner wall. For example, the ejectors 26 may not completely surround the burner wall in certain applications where the inventive burner is used in a furnace side wall location or where the burner must be specially configured to provide a particular flame shape.

To further facilitate the entrainment and mixing of flue gas in the fuel gas flow streams 44, the inventive burner can optionally include one or more exterior impact structures 45 positioned at least partially within the paths of the flow streams 44. Each such impact structure can generally be any type of obstruction which will decrease the flow momentum and/or increase the turbulence of the fuel gas streams 44 sufficiently to promote flue gas entrainment and mixing while allowing the resulting mixture to flow on to the combustion zone 46. Although other types of impact structures can be employed, the impact structure(s) 45 used in the inventive burner will most preferably be of a type which can be conveniently formed in a poured refractory as part of and/or along with the burner wall 6.

The burner wall 6 employed in inventive burner 2 has been formed to provide a particularly desirable tiered exterior shape wherein the diameter of the base 10 of the burner wall 6 is broader than the forward end 8 thereof and the exterior of the burner wall 6 presents a series of concentric, spaced apart impact ledges 45. The forward-most impact ledge 45 is defined by the outer edge of the forward end 8 of the burner wall 6. At least one additional impact ledge 45 is preferably positioned on the exterior of the burner wall 6 between the ejectors 26 and the forward end 8. Proceeding rearwardly from the forward end 8 of the burner wall 6, each succeeding impact ledge 45 is preferably broader in diameter than the preceding ledge.

As shown and described in U.S. Pat. No. 6,499,990, the exterior of the burner wall 6 could alternatively be formed, for example, to have only a single impact ledge provided at the forward end of the burner wall or to have a sloped (e.g., frustoconical) impact surface provided on the exterior wall of the burner which preferably tapers inwardly toward the combustion zone.

Figure 5:
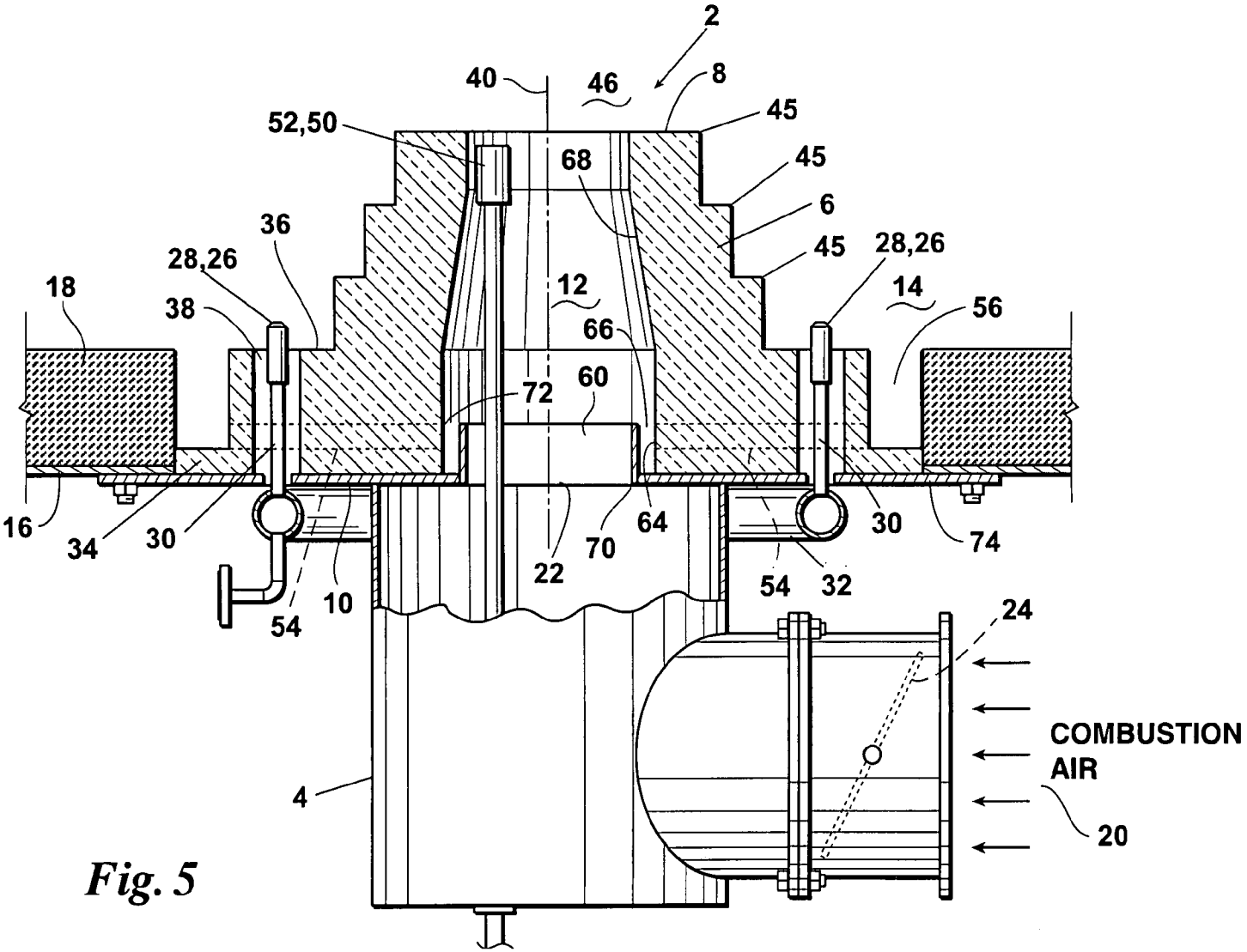
FIG. 5 is a cutaway elevational view of inventive burner 2 as seen from perspective 5-5 shown in FIG. 4.

The interior of the burner throat 12 can be straight or tapered or can have any other desired shape. As illustrated in FIGS. 1 and 5, the central air flow passageway 12 extending through the burner wall 6 of inventive burner 2 preferably comprises a tapered throat having a wider diameter at the base end 10 than at the forward end 8 of the burner wall 6. A tapered throat 12 of the type depicted in FIGS. 1 and 5 desirably provides a choke point for air flow at or near the forward end 8 of the burner and also desirably facilitates the creation of a reduced pressure region at the outer end of the burner. The creation of a reduced pressure zone at the outlet end of the air flow passageway 12 will assist in holding the combustion flame at the outer/forward end portion 8 of the burner wall 6. The reduced pressure region thus assists in stabilizing the burner operation and also assists in mixing the fuel gas 44 and the flue gas entrained therein with the combustion air flow.

In addition or as an alternative to using a tapered throat to create a reduced pressure region at the forward end 8 of the burner wall 6, a radial shoulder 48 is preferably formed just inside of the outer end of air flow passageway 12. As another alternative, a sloped surface of a type shown in U.S. Pat. No. 6,499,990 could be formed just inside of the outer end of the air flow passageway 12. Such structures preferably do not extend more than one inch, most preferably not more than one-half inch, into the outer end of the air flow passageway 12.

The inventive burner 2 can also optionally include one or more pilots 50 for igniting the burner flame in the combustion zone 46. The pilot 50 can be located in or outside of the air passageway 12. As shown in FIG. 5, the burner pilot 50 preferably extends through the central air passageway 12 such that the pilot ignition tip 52 is located substantially at the outer/forward end 8 of the burner wall 6.

In order to further reduce $NO_x$ emissions, the inventive burner and method also include significant improvements for (a) delivering even more inert flue gas to the combustion zone 46 and/or (b) significantly reducing the temperature of at least a large portion of the recirculated flue gas before it reaches combustion zone 46 and also preferably before it is combined with any of the combustion fuel. The improvement of inventive burner 2 preferably comprises one or more (preferably a plurality of) induction channels 54 provided through the burner wall 6 in a manner such that the combustion air flow 20 through the burner throat 12 will operate to draw (e.g., by suction, eduction or similar operation) an amount of flue gas from the interior 14 of the fired heating system into the central air passageway 12 of the burner. Moreover, in inventive burner 2, the induction of flue gas through the induction channel(s) 54 can be accomplished without the need to inject any combustion fuel or other motive fluid into the induction channel(s) 54.

As depicted in FIGS. 1-5, each induction channel 54 of the inventive burner 2 preferably extends laterally through the burner wall 6 near the base end 10 thereof. The inventive burner 2 preferably includes a plurality of radial induction channels 54 which extend through the burner wall 6 adjacent to the top of a lower radial skirt section 34 of the burner wall 6. The lower radial skirt 34 preferably abuts and seals against the interior insulation layer 18 on the furnace wall 16 such that a gap 56 surrounding the burner wall 6 is formed above the lower radial skirt 34 between the furnace insulation layer 18 and the lowermost exterior ledge portion 36 of burner wall 6. The inlet ends 58 of the induction channels 54 are located within gap 56, preferably at the lower end thereof, so that relatively cooler flue gas inside the heating system near the interior wall 16 thereof will be drawn into the induction channels 54 via the surrounding gap 56.

To further assist in drawing flue gas by suction through the induction channel(s) 54, a barrier 60 is preferably positioned in the central air passageway 12 such that the flow of combustion air 20 through the air passageway 12 will create a reduced pressure region 62 within the barrier 60 adjacent to the interior discharge opening 64 of each induction channel 54. The reduce pressure region is effective for drawing the flue gas through the induction channel(s) 54.

The improvement provided by inventive burner 2, wherein combustion air flow is used to draw inert flue gas by suction, eduction, or similar operation into the combustion process in order to lower the burner flame temperature, can be used to reduce $NO_x$ emissions in generally any type of burner, including burners having primary combustion zones within the interior of the burner wall. However, to achieve optimal performance and $NO_x$ reductions, the burner will preferably not include a primary combustion zone within the interior wall and will most preferably be a single stage burner having only a single combustion zone located substantially at the forward end of the burner wall. The presence of a primary combustion zone in the interior of the burner will typically reduce or prevent the achievement of significant flue gas cooling prior to combustion. In addition, depending upon the particular configuration employed, burners having a primary combustion zone within the interior of the burner wall can be susceptible to the primary flame being extinguished because of the large amount of inert flue gas introduced into the combustion air flow by the inventive system.

In the inventive burner 2, the interior barrier 60 preferably forms an annulus 66 which extends around and adjacent to the interior wall 68 of the central air passageway 12 and has a closed rearward end 70 and an open forward end 72. The interior discharge opening 64 of each induction channel 54 is preferably located within the annulus 66. The barrier 60 is preferably formed by an inward extension of the metal plate or flange 74 which is used for attaching the burner 2 to the furnace wall 16. This extension of the attachment plate or flange 74 preferably comprises a solid radial extension 76 which projects into the central air passageway 12 and a longitudinal wall segment 78 which projects forwardly in the air passageway 12 from the inner end of the radial plate extension 76. The width of the resulting gap 80 formed between the longitudinal barrier wall segment 78 of the barrier and the interior discharge openings 64 of the induction channels 54 will preferably be at least ¼ inch and will more preferably be at least ½ inch. Because of the circular cross-sectional shape of the central air passageway 12 of inventive burner 2, the particular longitudinal barrier wall 78 provided within burner 2 will preferably be cylindrical in shape.

The flue gas induction channel(s) 54 used in the inventive burner are preferably spaced rearwardly (i.e., toward base 10) from the forward end 8 of the burner wall an effective distance to allow the induced flue gas to mix with and/or be cooled by the combustion air flow 20 sufficiently, prior to reaching the combustion zone 46, to further reduce the $NO_x$ emissions produced by burner 2. Each induction channel 54 will preferably be located in the vicinity of the base end 10 of the burner wall 6. For most industrial applications, the distance from the discharge opening 64 of each induction channel 54 to the forward end 8 of the burner wall 6 will preferably be at least 1 inch and will more preferably be at least 2 inches.

Figure 2:
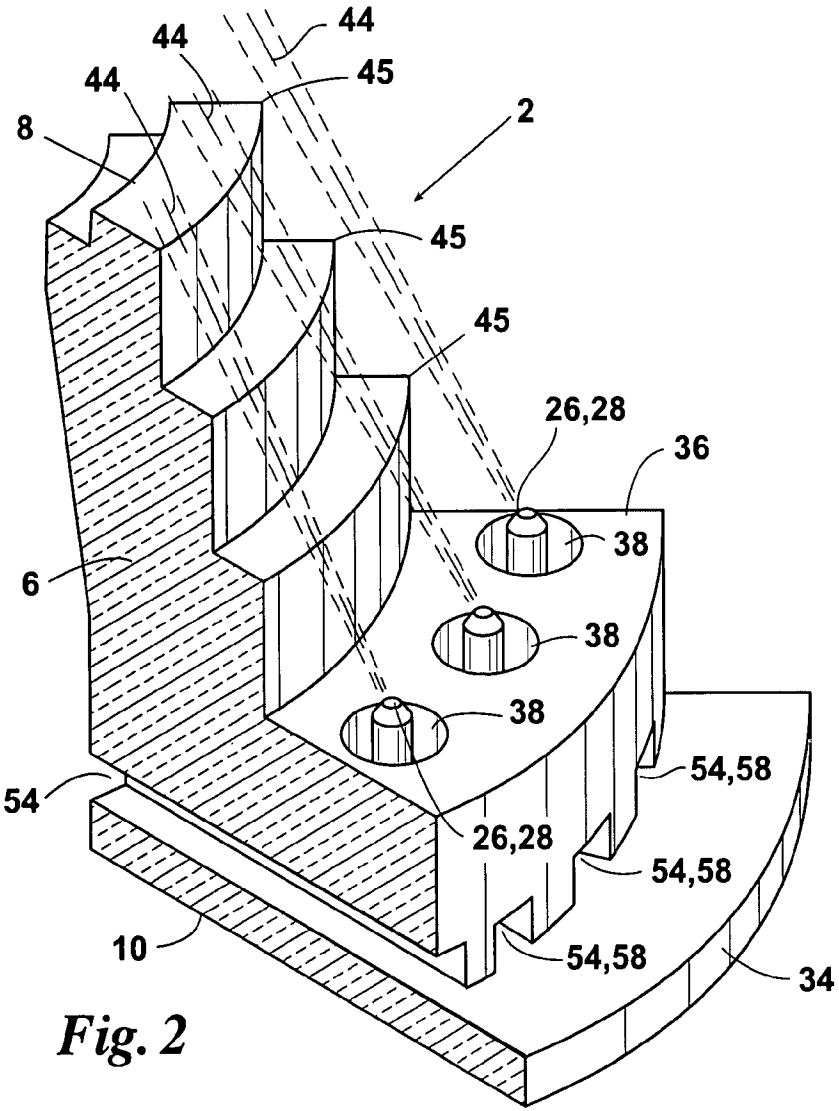
FIG. 2 is a perspective exterior sectional view of the inventive low $NO_x$ burner 2.
Figure 4:
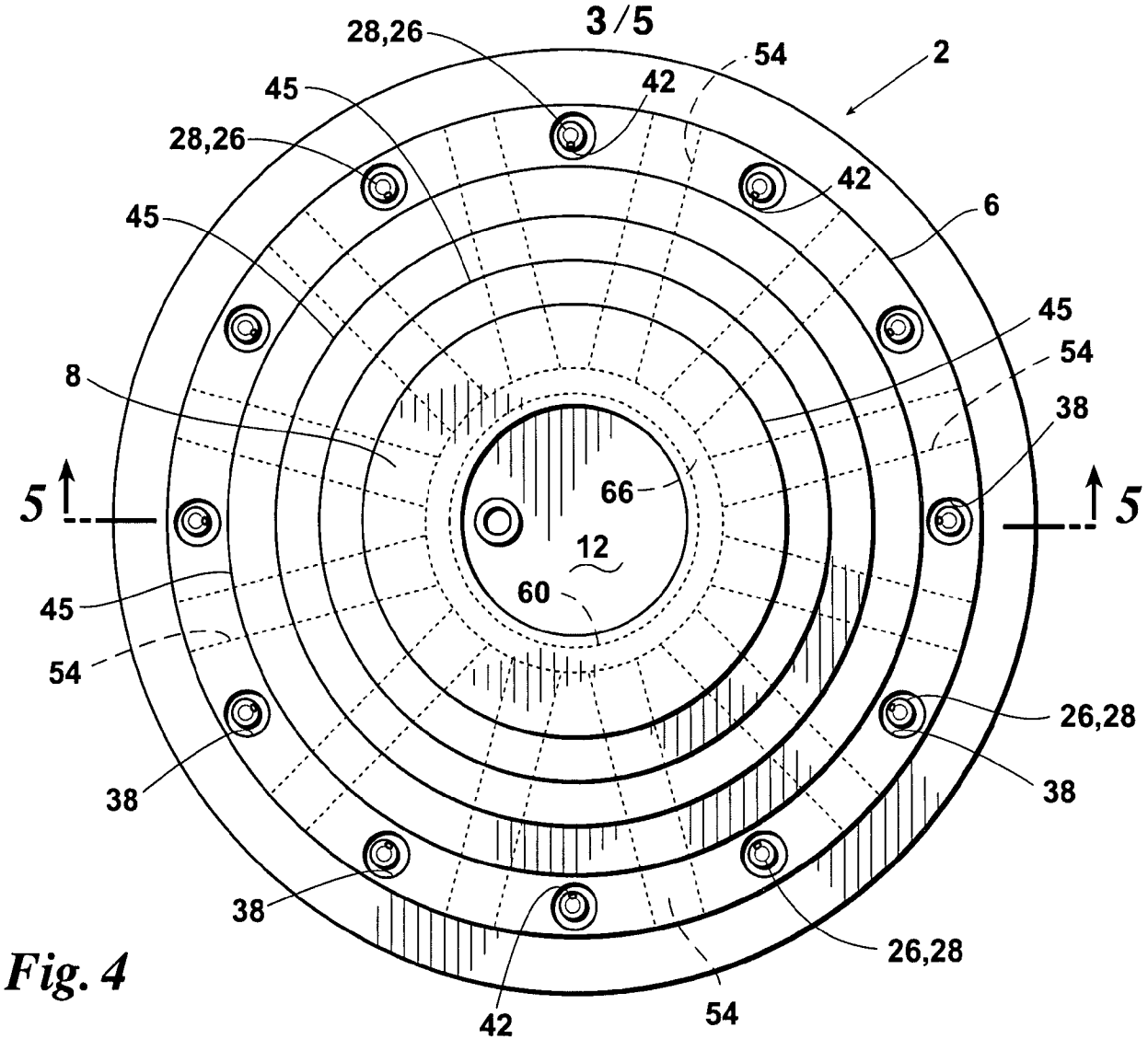
FIG. 4 is a plan view of inventive burner 2.

As shown in FIGS. 2 and 4, embodiment 2 of the inventive burner preferably includes a sufficient number of radial flue gas induction channels 54 such that an induction channel is provided between each adjacent pair of ejectors 26. It will be understood, however, that generally any arrangement and number of induction channels 54 and/or ejectors 26 can be used. In addition, although the inventive burner 2 has been described as having only a single combustion zone 46, it will be understood that the inventive burner could have one or more additional combustion stages beyond the combustion zone 46 or could employ other combustion zone arrangements at the forward end 8 of the burner wall 6 and/or at generally any other locations which are preferably not contained rearwardly of combustion zone 46 within the burner wall 6.

Figure 6:
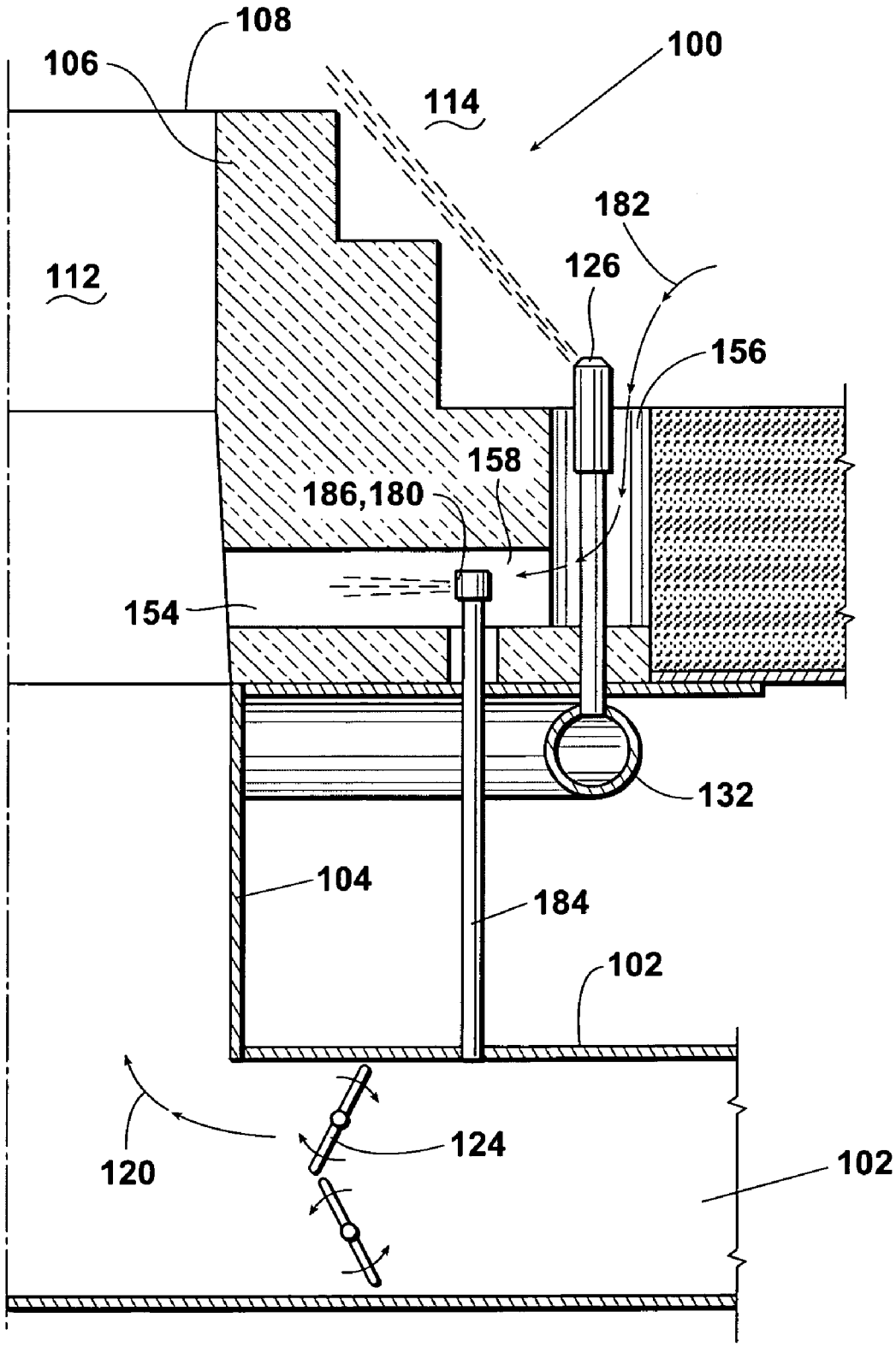
FIG. 6 is a cutaway elevational view of an embodiment 100 of the inventive low $NO_x$ burner.

An alternative embodiment 100 of the inventive low $NO_x$ burner is illustrated in FIG. 6. As with the inventive burner 2, the inventive burner 100 is preferably a single stage burner wherein the burner wall 106 includes: a central air passageway 112 extending therethrough; a forward end opening 108 which is in communication with the interior 114 of a furnace or other heating system enclosure which contains a flue gas; and one or more, preferably a plurality of, flue gas induction channels 154 which preferably extend laterally through the burner wall 106 near the base end thereof.

Also similar to inventive burner 2, the inventive burner 100 preferably comprises: an inlet air duct 102 having a damper or other regulating device 124 therein; one or more, preferably a plurality of, outer fuel gas ejectors 126 extending from a fuel supply manifold 132; and an outer gap 156 surrounding the burner wall 106. The inlet ends 158 of the induction channels 154 are located in the outer gap 156.

The inventive burner 100 differs from the inventive burner 2 in that the inventive burner 100 additionally includes one or more jet(s) 180 which is/are positioned in one, some, or all of the flue gas induction channels 154. The jet(s) 180 discharge combustion air or inert gas, preferably air, through the induction channel(s) 154 toward the central air passageway 112 of the burner wall 106. The discharge of combustion air or inert gas from the jet(s) 180 operates to draw flue gas 182 into the induction channel(s) 154 and also promotes mixing and cooling of the flue gas 182 in the induction channel(s) 154.

Each jet 180 is preferably an air jet comprising an ejector tip, a nozzle, or other discharge element 186 secured within the induction channel 154 on the end of an air pipe or other conduit 184. In order to provide sufficient pressure or pressure differential for delivering combustion air into the induction channel(s) 154 using the air jet(s) 180, the air conduit (s) 184 will preferably be connected to the inlet air ducting 102 upstream of the inlet air regulating device 124. In addition, to further ensure an adequate pressure and flow rate for operation of the air jet(s) 180, a forced draft system will preferably be used to supply combustion air to the inventive burner 100.

As with the inventive burner 2, the inventive burner 100 preferably includes a plurality of flue gas induction channels 154 which surround the central passageway 112. The inventive burner 100 preferably also comprises a plurality of fuel gas ejectors 126 which surround the central air passageway 112. Most preferably, the fuel gas ejectors 126 are in alternating relationship with the flue gas induction channels 154.

The inventive burner 100 can also be operable in the same manner as inventive burner 2 such that the flow of combustion air 120 through the central air passageway 112 of the burner wall 106 will operate to draw an additional amount of the flue gas through one or more of the flue gas induction channels 154. Thus, in accordance of the present invention, flue gas can be drawn through each individual flue gas induction channel by either (a) the operation of the combustion air flow through the central air passageway of the burner, (b) the discharge of air or inert gas into the induction channel toward the central air passageway, or (c) both. In each case, flue gas will preferably be drawn through the flue gas induction channel without introducing any combustion fuel into the channel.

Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modifications are encompassed within the spirit of this invention as defined by the appended claims.

What is claimed is:

1. A burner for providing reduced $NO_x$ emissions in a heating system having a flue gas therein, said burner comprising:

a burner wall having an air passageway therein for delivering a flow of air for combustion;

a plurality of flue gas induction channels extending through said burner wall and having outlet openings in said air passageway, wherein said flue gas induction channels surround said air passageway;

a barrier positioned in said air passageway such that said flow of air will create a reduced pressure region within said barrier adjacent to said outlet openings effective for drawing an amount of said flue gas into said air passageway through said flue gas induction channels; and a plurality of fuel gas ejectors positioned to deliver flue gas outside of said burner wall toward a forward end of said burner wall.

2. The burner of claim 1 wherein:

said air passageway has an interior surface;

said barrier comprises a longitudinal wall within said air passageway which is spaced apart from said interior surface such that an annulus is formed between said longitudinal wall and said interior surface; and said outlet openings of said flue gas induction channels are located in said annulus.

3. The burner of claim 2 wherein an initial end of said annulus upstream of said outlet openings is closed.

4. The burner of claim 1 wherein said flue gas induction channels extend laterally through said burner wall.

5. The burner of claim 1 wherein said fuel gas ejectors surround said air passageway in alternating relationship with said flue gas induction channels.

6. The burner of claim 5 wherein said fuel gas ejectors are spaced not more than four inches apart.

7. A method for reducing $NO_x$ emissions from a burner in a heating system having a flue gas therein, said burner including a burner wall having a forward end and an interior passageway having an outlet at said forward end, and said burner including a combustion zone wherein a combustion fuel is burned, said combustion zone beginning substantially at said forward end, said method comprising the step of delivering a flow of air for combustion through said interior passageway toward said combustion zone in a manner such that said flow of air creates a reduced pressure region in said interior passageway which draws an amount of said flue gas into said flow of air in said interior passageway prior to said flow of air reaching said combustion zone wherein:

said burner is operated such that there is no additional combustion stage located within said burner wall prior to said combustion zone, said amount of flue gas is drawn into said interior passageway in said step of delivering via at least one induction channel extending through said burner wall, said induction channel has an outlet opening in said interior passageway, and said reduced pressure region is created within a barrier in said interior passageway adjacent to said outlet opening of said induction channel.

8. The method of claim 7 wherein said induction channel extends laterally through said burner wall.

9. The method of claim 7 wherein no motive fluid is delivered through said induction channel to said interior passageway.

10. The method of claim 7 further comprising the step of discharging air into at least one induction channel through said burner wall in a manner effective for drawing an additional amount of said flue gas into said interior passageway.

11. The method of claim 7 wherein none of said combustion fuel is added to said flow of air prior to said flow of air and said amount of flue gas arriving at said combustion zone.

12. The method of claim 11 further comprising the step of ejecting said combustion fuel outside of said burner wall such that said combustion fuel travels outside of said burner wall to said combustion zone.

13. The method of claim 7 wherein said amount of flue gas is drawn into said interior passageway in said step of delivering via a plurality of induction channels extending through said burner wall.

14. The method of claim 13 wherein said induction channels extend laterally through said burner wall.

15. The method of claim 13 wherein no motive fluid is delivered through said induction channels to said interior passageway.

16. A method for reducing NOx emissions from a burner in a heating system having a flue gas therein, said burner including a burner wall having a forward end and an interior passageway having an outlet at said forward end, and said burner including a combustion zone wherein a combustion fuel is burned, said combustion zone beginning substantially at said forward end, and said comprising the step of delivering a flow of air for combustion through said interior passageway toward said combustion zone in a manner such that said flow of air creates a reduced pressure region in said interior passageway which draws an amount of said flue gas into said flow of air in said interior passageway prior to said flow of air reaching said combustion zone, wherein:

said burner is operated such that there is no additional combustion stage located within said burner wall prior to said combustion zone, said amount of flue gas is drawn into said interior passageway in said step of delivering via a plurality of induction channels extending through said burner wall, said induction channels have outlet openings in said interior passageway, and wherein said reduced pressure region is created within a barrier in said interior passageway adjacent to said outlet openings of said induction channels.

17. The method of claim 16 wherein said outlet openings of said induction channels are located within an annulus in said interior passageway formed by said barrier.

18. The method of claim 16 wherein said induction channels surround said interior passageway.

19. A method for reducing NOx emissions from a burner in a heating system having a flue gas therein, said burner including a burner wall having a forward end and an interior passageway having an outlet at said forward end, and said burner including a combustion zone wherein a combustion fuel is burned, said combustion zone beginning substantially at said forward end, and said method comprising the step of delivering a flow of air for combustion through said interior passageway toward said combustion zone in a manner such that said flow of air creates a reduced pressure region in said interior passageway which draws an amount of said flue gas into said flow of air in said interior passageway prior to said flow of air reaching said combustion zone, wherein said burner is operated such that there is no additional combustion stage located within said burner wall prior to said combustion zone, said amount of flue gas is drawn into said interior passageway in said step of delivering via a plurality of induction channels extending through said burner wall, said induction channels surround said interior passageway, and said method further comprising the step of ejecting said combustion fuel outside of said burner wall to said combustion zone from a plurality of ejectors which are positioned around said interior passageway in alternating relationship with said induction channels.

20. In a burner for combusting a combustion fuel in a heating system, said heating system having a flue gas therein, said burner including a burner wall having an air passageway therein for delivering a flow of air for combustion, and said burner having a fuel combustion zone beginning substantially at a forward end portion of said burner wall, the improvement comprising:

at least one flue gas induction channel extending through said burner wall to said air passageway;

a jet positioned in said flue gas induction channel which will discharge air or an inert gas in a manner effective for drawing an amount of said flue gas into said flue gas induction channel and delivering said amount of said flue gas to said air passageway;

said burner having no additional combustion stage within said burner a prior to said fuel combustion zone; and said burner being operable such that substantially none of said combustion fuel will be added to said flow of air prior to said flow of air and said amount of flue gas arriving at said fuel combustion zone.

21. The burner of claim 20 wherein the improvement further comprises said flue gas induction channel extending laterally through said burner wall.

22. The burner of claim 20 further comprising at least one fuel gas ejector positioned to deliver fuel gas outside of said burner wall toward said fuel combustion zone.

23. The burner of claim 20 wherein the improvement further comprises an air conduit for delivering air to said jet.

24. The burner of claim 23 wherein the improvement further comprises:

an air duct for delivering said flow of air for combustion to said air passageway and said air conduit will receive air from said air duct.

25. The burner of claim 24 wherein the improvement further comprises said air conduit being connected to said air duct at a point upstream of a regulating device for regulating said flow of air for combustion into said air passageway.

26. In a burner for combusting a combustion fuel in a heating system, the heating system having a flue gas therein and said burner including a burner wall having an air passageway therein for delivering a flow of air for combustion, and said burner having a fuel combustion zone beginning substantially at a forward end of said burner wall, the improvement comprising:

a plurality of induction channels extending through said burner wall to said air passageway;

a plurality of jets positioned in said induction channels which will discharge air or an inert gas in a manner effective for drawing an amount of said flue gas into said flue gas induction channels and delivering said amount of said flue gas to said air passageway;

said burner having no additional combustion stage within said burner wall prior to said fuel combustion zone; and a plurality of fuel gas ejectors positioned to deliver fuel gas outside of said burner wall toward said fuel combustion zone.

27. The burner of claim 26 wherein the improvement further comprises said induction channels extending laterally through said burner wall.

28. The burner of claim 26 wherein the improvement further comprises said induction channels surrounding said air passageway.

29. The burner of claim 28 wherein the improvement further comprises said fuel gas ejectors surrounding said air passageway in alternating relationship with said induction channels.

30. The burner of claim 26 wherein the improvement further comprises:

said induction channels having outlets in said air passageway and said outlets being positioned in said air passageway in a manner effective for cooling and/or mixing said amount of flue gas sufficiently with said flow of air for combustion prior to said amount of flue gas reaching said fuel combustion zone to provide reduced $NO_x$ emissions from said burner.

31. The burner of claim 26 wherein the improvement further comprises air conduits for delivering air to said jets.

32. The burner of claim 31 wherein the improvement further comprises:

an air duct for delivering said flow of air for combustion to said air passageway and said air conduits will receive air from said air duct.

33. The burner of claim 32 wherein the improvement further comprises said air conduits will receive air from said air duct upstream of an air regulating device for regulating said flow of air for combustion into said air passageway.

34. A method of reducing $NO_x$ emissions from a burner in a heating system having a flue gas therein, said burner including a burner wall having a forward end and an interior passageway through which a flow of air is delivered, said interior passageway having an outlet at said forward end, and said burner including a combustion zone wherein a combustion fuel is burned, said combustion zone beginning substantially at said forward end, said method comprising a step of discharging air or an inert gas into at least one induction channel, said induction channel extending through said burner wall to said interior passageway, in a manner effective for drawing an amount of said flue gas into said induction channel and delivering said amount of said flue gas to said interior passageway, wherein said burner is operated such that there is no additional combustion stage located within said burner wall prior to said combustion zone and none of said combustion fuel is added to said flow of air prior to said flow of air and said amount of flue gas arriving at said combustion zone.

35. The method of claim 34 wherein said induction channel extends laterally through said burner wall.

36. The method of claim 34 wherein, in said step of discharging, air or an inert gas is discharged into a plurality of induction channels, said induction channels extending through said burner wall to said interior passageway, in a manner effective for drawing said amount of said flue gas into said induction channels and delivering said amount of said flue gas to said interior passageway.

37. The method of claim 36 wherein said induction channels extend laterally through said burner wall.

38. The method of claim 36 wherein said induction channels surround said interior passageway.

39. The method of claim 38 further comprising the step of ejecting said combustion fuel outside of said burner wall to said combustion zone from a plurality of ejectors which are positioned around said interior passageway in alternating relationship with said induction channels.

40. The method of claim 36 wherein air is discharged into said induction channels in said step of discharging.

41. The method of claim 34 wherein air is discharged into said induction channel in said step of discharging.

42. In a burner for combusting a combustion fuel in a heating system, the heating system having a flue gas therein and said burner including a burner wall having an air passageway therein for delivering a flow of air for combustion, and said burner having a fuel combustion zone beginning substantially at a forward end portion of said burner wall, the improvement comprising:

a plurality of induction channels extending through said burner wall to said air passageway;

a plurality of jets positioned in said induction channels which will discharge air or an inert gas in a manner effective for drawing an amount of said flue gas into said induction channels and delivering said amount of said flue gas to said air passageway;

said burner having no additional combustion stage within said burner wall prior to said fuel combustion zone; and said burner being operable such that substantially none of said combustion fuel will be added to said flow of air for combustion prior to said flow of air for combustion and said amount of flue gas arriving at said fuel combustion zone.

43. A method of reducing NOx emissions from a burner in a heating system having a flue gas therein, said burner including a burner wall having a forward end and an interior passageway having an outlet at said forward end, and said burner including a combustion zone wherein a combustion fuel is burned, said combustion zone beginning substantially at said forward end, said method comprising the steps of:

(a) discharging air or an inert into at least one induction channel, said induction channel extending through said burner wall to said interior passageway, in a manner effective for drawing an amount of said flue gas into said induction channel and delivering said amount of said flue gas to said interior passageway, wherein said burner is operated such that there is no additional combustion stage located within said burner wall prior to said combustion zone and (b) ejecting said combustion fuel outside of said burner wall such that said combustion fuel travels outside of said burner wall to said combustion zone.

* * * * *

UNITED STATES PATENT AND TRADEMARK OFFICE

CERTIFICATE OF CORRECTION

PATENT NO. : 7,670,135 B1
APPLICATION NO. : 11/180387
DATED : March 2, 2010
INVENTOR(S) : Zink et al.

It is certified that error appears in the above-identified patent and that said Letters Patent is hereby corrected as shown below:

Column 11, Line 16, Claim 16 – the word --method-- is inserted between the words "said" and "comprising".

Column 14, Line 37, Claim 43 – the word --gas-- is inserted between the words "inert" and "into".

Signed and Sealed this

Thirteenth Day of April, 2010

David J. Kappos

David J. Kappos
*Director of the United States Patent and Trademark Office*